US005154657A

United States Patent [19]

Wildman et al.

[11] Patent Number: 5,154,657

[45] Date of Patent: Oct. 13, 1992

[54] WHEELED JET REACTION TOY

[75] Inventors: John R. Wildman; Mark Luecke, both of North Riverside, Ill.

[73] Assignee: Play Mates Toys Limited Company, Hong Kong, Hong Kong

[21] Appl. No.: 832,713

[22] Filed: Feb. 7, 1992

[51] Int. Cl.[5] ..... A63H 27/26; A63H 33/00; A63H 17/00; A63H 29/00

[52] U.S. Cl. ..... 446/211; 446/71; 446/78; 446/429; 124/63

[58] Field of Search ..... 446/71, 74, 76, 77, 446/78, 176, 199, 210, 211, 212, 186, 187, 429, 430, 465, 470, 471; 124/56, 63, 65

[56] References Cited

U.S. PATENT DOCUMENTS

| | | | |
|---|---|---|---|
| 1,787,034 | 12/1930 | Burns | 446/78 |
| 3,154,882 | 11/1964 | LaBossiere | 446/78 |
| 3,740,896 | 6/1972 | Glass et al. | 446/212 |
| 3,777,392 | 12/1973 | Span et al. | 446/78 |
| 3,815,281 | 6/1974 | Kender | 446/77 |
| 3,883,983 | 5/1975 | Coster | 446/78 |
| 4,438,587 | 3/1984 | Marino | 446/202 |
| 4,714,444 | 12/1987 | Rendell | 446/77 X |
| 5,032,100 | 7/1991 | Goldfarb | 446/187 |

FOREIGN PATENT DOCUMENTS

| | | | |
|---|---|---|---|
| 161579 | 5/1954 | Australia | 446/212 |
| 2587911 | 4/1987 | France | 446/212 |

*Primary Examiner*—D. Neal Muir

[57] ABSTRACT

A wheeled jet reaction toy including a wheeled vehicle adapted to carry an empty beverage can of the "pop top" type having an opening at one end. The vehicle is adapted to clamp the empty beverage container with its open "pop top" end facing rearwardly. An exhaust tube mounted on the vehicle communicates with the empty beverage container through the "pop top opening". An air pump is mounted on a launch pad and a nozzle is connected by a hose to the air pump with the nozzle extending into the exhaust tube when the vehicle is straddling the launch pad so that air under pressure can be transmitted by the pump through the exhaust tube and into the beverage container. The vehicle containing the beverage container is held in position at the launch pad by a guillotine type quick release mechanism which engages the end of the exhaust tube and holds it against a seal surrounding the nozzle. A check valve is provided in the nozzle to prevent the escape of air from the beverage container until the vehicle is released from the launch pad under the propulsion force of the escaping compressed air. In this embodiment of the invention, the vehicle is wheeled and an over center clamping mechanism is provided to restrain the beverage container in the vehicle.

6 Claims, 1 Drawing Sheet

WHEELED JET REACTION TOY

BACKGROUND AND SUMMARY OF THE INVENTION

This invention is directed to a toy vehicle which uses an empty beverage container to provide jet propulsion for the vehicle.

An object of this invention is a vehicle using an empty "pop top" beverage container which acts as a reservoir for compressed air to propel the vehicle by discharging the air through an exhaust tube.

Another object of this invention is a jet propelled toy vehicle in which the vehicle is held prior to launching on a launching pad so that the beverage container can be pumped full of air from a hand pump and quickly released when the beverage container is charged to full pressure.

Another object of this invention is a jet propelled vehicle which utilizes a hand pump and will retain the compressed air in the vehicle until the vehicle is released from its launch pad.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figures 1, 2, 3, 4, 5, 6, 7, 8:
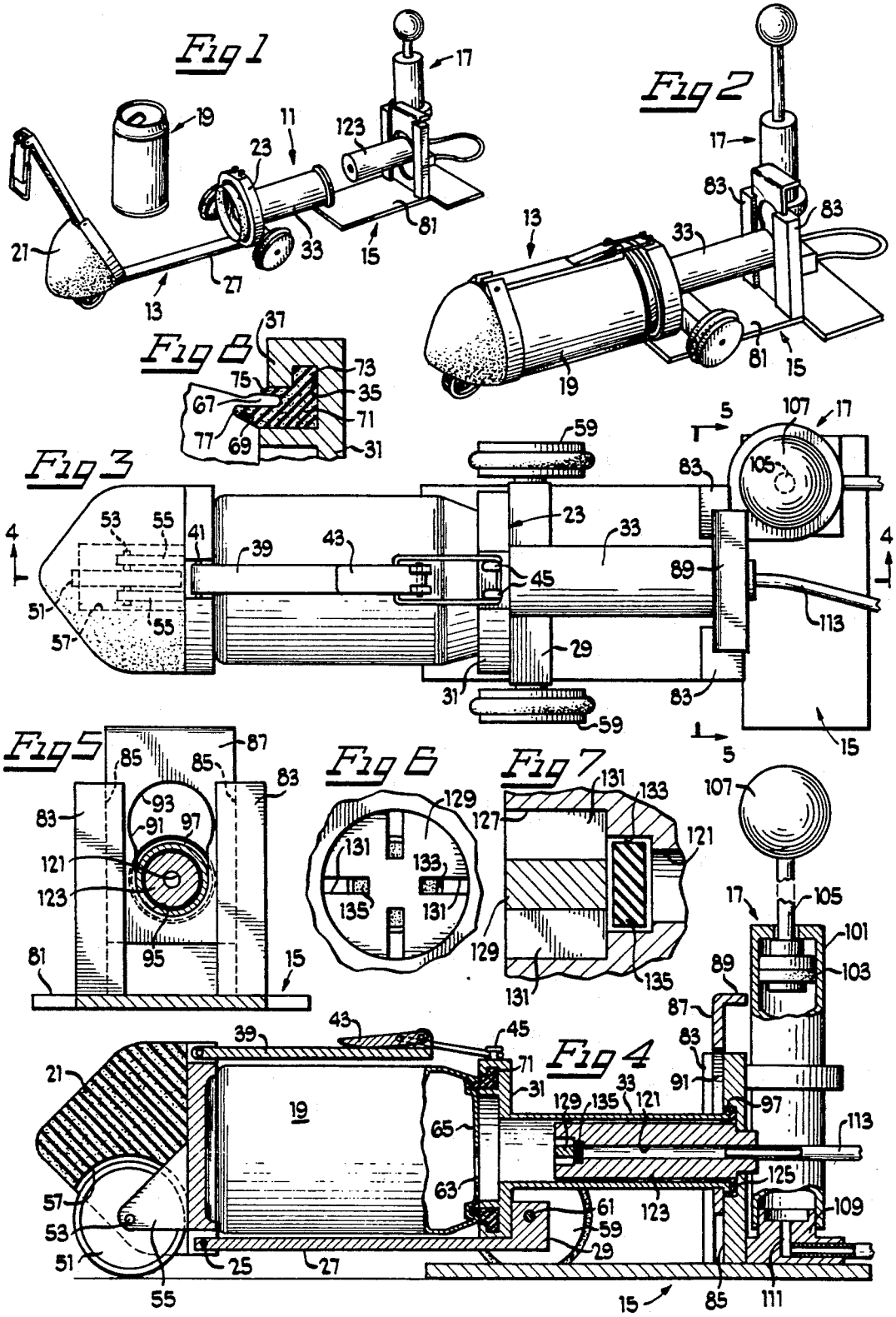
FIG. 1 is an exploded perspective view of the apparatus of this invention.
FIG. 2 is a perspective view of the apparatus of this invention ready for launching.
FIG. 3 is an enlarged top plan view of the apparatus of this invention as shown in FIG. 2.
FIG. 4 is a cross sectional view taken along line 4—4 of FIG. 3.
FIG. 5 is a cross sectional view taken along line 5—5 of FIG. 3.
FIG. 6 is an enlarged end view of the check valve mechanism of this invention.
FIG. 7 is an enlarged longitudinal view of the check valve mechanism of this invention.
FIG. 8 is an enlarged partial cross sectional view of the sealing mechanism of this invention.

FIG. 1 of the drawings shows the jet propelled toy 11 of this invention in a somewhat exploded view before assembly for launching. It includes a vehicle 13, a launch pad 15, an air pump 17 and an empty beverage container 19. The beverage container 19 may be of the common or conventional "pop top" container having a lifting ring operated opening flap that uncovers a passage in one end of the beverage container but retains the flap inside the beverage container. Of course, an old fashioned beverage container where a hole is punched in the top wall of the container may also be used.

The vehicle 13 includes a nose portion 21 which may be formed of a soft elastomeric material to reduce the possibility of injury to children or other persons who may get in the path of travel of the vehicle. The vehicle also includes an exhaust assembly 23 at the opposite end of the vehicle from the nose. A pivotal shaft 25 connects a longitudinal frame 27 to the nose portion 21. A cross piece 29 of rectangular cross section is attached to the lower portion of a ring shaped housing 31 formed as part of the exhaust assembly 23. An annular tube 33 formed integrally with the housing 31 extends rearwardly from the ring shaped housing 31. The ring shaped housing is formed with an inwardly facing groove 35 having an annular shoulder 37 at the forward end of the groove as shown in enlarged detail in FIG. 8 of the drawings. A longitudinally extending strap 39 at the top of the vehicle is pivotally connected at its front by a shaft 41 to the nose portion 21. An over center pivotal latch 43 engages lugs 45 on the top of the ring housing 31 to clamp the beverage container 19 in position in the vehicle.

A wheel 51 is mounted on an axle 53 extending between brackets 55 located in a cut out portion 57 at the bottom of the nose 21. Rear wheels 59 are mounted on an axle 61 which extends through the rectangular cross piece 29 of the longitudinal frame member 27.

As shown most clearly in FIGS. 4 and 8 of the drawings, the beverage container 19 has an opening 63 in the top end wall 65 of the container which is created when the "pop top" ring and lever are operated. As is conventional and is most clearly shown in FIG. 8 of the drawings, such a container has a rim 67 surrounding the end wall 65 with an annular groove 69 located inwardly of the rim. To seal the beverage container 19 relative to the exhaust assembly 23, a flexible seal 71 is seated in the inwardly facing groove 35 of the ring shaped housing 31 and is held in position by the shoulder 37. This seal which may be formed of a suitable plastic or rubber has a radially extending flange 73 which seats in the inwardly facing groove 35, a short outer lip 75 which engages the outside of the rim 67 of the beverage container 19 and a longer inner lip 77 which seats in the groove 69 of the beverage container. When the beverage can is positioned in the vehicle 13 and the over center pivotal latch 43 is rotated to its closed position shown in FIG. 4 of the drawings, the top end wall 65 of the container 19 is compressed between the seal 71 and the nose 21 of the vehicle.

The launch pad 15 has a base 81 on which are mounted a pair of spaced apart upstanding guides 83 shown in detail in FIG. 5 of the drawings. Vertical grooves 85 are formed in the upstanding guides 83 and a guillotine-like plate 87 having a horizontally turned ledge at its upper end reciprocates in the guides 83. A keyhole slot 91 shown in FIG. 5 of the drawings is formed in the plate 87. The slot has a larger circular opening 93 in the upper part of the keyhole and a smaller opening 95 in the lower part. The edges around the smaller opening 95 engage an annular shoulder 97 formed on the exhaust tube 33 locking the annular tube 33 and the attached vehicle 13 against longitudinal movement away from the launching pad 81.

The air pump 17 shown in detail in FIG. 4 of the drawings includes a vertical cylinder 101 in which is located a piston 103. The piston 103 is connected to a rod 105 which extends upwardly out of the cylinder 101. A round ball type handle 107 is attached to the top of the rod 105. A plug 109 is located in the base of the cylinder 101. A passage 111 through this plug connects to a flexible tube 113 which at its opposite end fits into a passage 121 formed in a cylindrical nozzle 123. The nozzle 123 telescopes inside the exhaust tube 33 of the exhaust assembly 23. The outer end of the nozzle 123 is seated in the upstanding guides 83 with a rubber sealing ring 125 trapped between the guides 83 and the annular shoulder 97 of the exhaust tube 33 to prevent leakage of air around the nozzle 123.

At the vehicle end of the nozzle 123, the passage 121 is enlarged at 127 to provide a chamber for a circular plug 129. The plug 129 is formed with four slots 131 each extending radially inwardly from the periphery of the plug and terminating short of the center of the plug. Another chamber 133 larger than the passage 121 but smaller than the chamber 127 is formed between the chamber 127 and the passage 121. A rubber disc 135 is positioned in the chamber 133. The rubber disc 135 is smaller in diameter than that of the chamber 133 but greater than that of the passage 121 so that air may flow through the passage 121 from the air pump 17 through the annular exhaust tube 33 and into the beverage container 19 but not in the reverse direction.

In operating the vehicle, an empty beverage container 19 is positioned on the strap 27 of the vehicle 13 with the opening 63 in its top end 65 facing in a forwardly direction. The rim 67 of the container 19 engages the seal 71 on the ring shaped housing 31 of the vehicle. The over center pivotal latch 43 is engaged with the lugs 45 on the ring shaped housing 31 and pivoted to its closed position to entrap the beverage container 19 in the vehicle as shown in FIGS. 2 and 4 of the drawings. The seal 71 seals the beverage container relative to the exhaust assembly tubing 33. The pump 17 is then operated to force air under pressure through the flexible tubing 113, the passage 121 in the nozzle 123, past the rubber disc 135 and into the beverage container 19 through its opening 63. When the pump has increased the air pressure in the container 19 to a desired level, the guillotine plate 89 may be pushed downwardly so that the annular shoulder 97 of the tube 33 escapes through the opening 93 in the guillotine plate 87. The pressure of air in the container acting through the nozzle 133 will propel the vehicle 12 away from the launch pad 81 at high speed.

We claim:

1. A jet reaction toy including:

a vehicle adapted to carry an empty beverage container having an opening in one end wall thereof, said empty beverage container carried on said vehicle with its end wall containing said opening facing rearwardly, an exhaust tube on said vehicle communicating with said opening in said empty beverage can, means to connect said vehicle to a source of air under pressure and to transmit said air under pressure through said exhaust tube and into said empty beverage container, and means to retain said air under pressure in said beverage container until said vehicle is disconnected from said source of air under pressure.

2. The jet reaction toy of claim 1 further including a seal compressed between said beverage container and said exhaust tube.

3. The jet reaction toy of claim 1 in which said beverage can is of the type having a rim surrounding its end wall opening and a groove located inside said rim and outwardly of said opening, said seal having an inner lip which fits into said groove and an outer lip that fits outwardly of said rim.

4. The jet reaction toy of claim 3 in which said seal is mounted on said exhaust tube.

5. The jet reaction toy of claim 1 in which said means to connect said vehicle to a source of air under pressure and to transmit air under pressure through said exhaust tube includes a nozzle which telescopes into said exhaust tube and has an air passage extending therethrough, a check valve in said air passage and a seal between said nozzle and said exhaust tube.

6. The jet reaction toy of claim 5 in which said means to retain said air under pressure in said beverage container until said vehicle is disconnected from said source of air pressure includes means engaging said exhaust pipe when it is in telescoping relationship over said nozzle to hold said exhaust tube against said seal and quick release means to disengage said exhaust tube to allow the escape of air from said empty beverage container through said exhaust tube to disconnect said vehicle from said source of air under pressure.

* * * * *